United States Patent [19]

Norris

[11] 4,353,434

[45] Oct. 12, 1982

[54] FLUID BLOW-OFF MUFFLER

[76] Inventor: Thomas R. Norris, 15 Patricia Rd., Orinda, Calif. 94563

[21] Appl. No.: 249,218

[22] Filed: Mar. 30, 1981

[51] Int. Cl.³ ..... F01N 1/24

[52] U.S. Cl. ..... 181/258

[58] Field of Search ..... 181/230, 253, 257, 258, 181/236–239

[56] References Cited

U.S. PATENT DOCUMENTS

| | | | |
|---|---|---|---|
| 226,905 | 4/1880 | Curie | 181/257 |
| 1,519,527 | 12/1924 | Bumbaugh et al. | 181/253 |
| 2,625,234 | 1/1953 | Fina | 181/257 X |

FOREIGN PATENT DOCUMENTS

| | | | |
|---|---|---|---|
| 10047 | of 1891 | United Kingdom | 181/258 |
| 250399 | 4/1926 | United Kingdom | 181/258 |

*Primary Examiner*—L. T. Hix

*Assistant Examiner*—Thomas H. Tarcza

*Attorney, Agent, or Firm*—D. L. Hagmann

[57] ABSTRACT

An improved muffler is provided for attenuating noise generated by a pressurized fluid when released to the atmosphere. Use of a combination fill-pack and void volume gas collector herein permits effective operation with a much smaller unit than normally required.

10 Claims, 4 Drawing Figures

FLUID BLOW-OFF MUFFLER

BACKGROUND OF THE INVENTION

Field of the Invention

This invention relates to a device for attenuating noise generated by a pressurized fluid when released to the atmosphere, especially steam, for example from a geothermal power plant.

Electric power generation using steam from geothermal wells is of increasing importance, especially in view of escalating costs for petroleum-derived fuels. Serious difficulties, however, are experienced in using geothermal steam. Because of low quality of this steam (dirty steam), including its content of water, corrosive materials, such as hydrogen sulfide and the like, and of entrained solids, it is often necessary to discontinue flow the steam to the generator for purposes of upkeep and maintenance. It is usually impractical to suddenly interrupt flow from a geothermal well, for example by closing a valve. Unless continued flow is maintained, the well tends to deteriorate. Practice has been to by-pass the generator and vent the steam to the atmosphere, but this results in high noise levels. Unplanned steam releases are relatively frequent, large and lengthy at a geothermal power plant. Accordingly, some means for reducing noise is required.

Mufflers of the rock-filled type are known and used for attenuating noise generated by a pressurized fluid upon release to the atmosphere. These generally consist of a container filled with rock aggregate, typically of 1 to 6 inch screening. Steam is introduced at or near the bottom, passes through the body of the aggregate and exits from the surface. In order to prevent ejection of the fill, conventional rock filled mufflers are very large and hence costly and difficult to site. In general, the fill is not held in place by a screen or grill because a failure could cause a sudden dangerous ejection of hot rock.

Blow-off silencers fabricated of steel, steel and fiber glass combinations, and the like, see only limited use in geothermal service because of fatigue and corrosion problems and the resulting concerns regarding safety and reliability.

An object herein is to provide an improved blow-off muffler of reduced size, improved resistance to corrosion and reduced cost.

Other objects will be clear from the description to follow.

SUMMARY OF THE INVENTION

In accordance with the present invention an improved particle-fill, blow-off muffler is provided for attenuating noise generated by the expansion of a stream of pressurized fluid into the atmosphere, comprising having a void volume in communication with said fill, said void volume ventillating said muffler to the atmosphere, being defined by a shell containing holes or openings and passing at least a major portion of said stream, after passage through a portion of said fill, to the atmosphere.

In a particular aspect, the stream is introduced via a distributor into a basal or lateral compartment of the muffler, said compartment being separated from the fill by a perforated element selected from the group consisting of masonry, a concrete floor or wall, wire mesh screen, metal plate and metal grid.

In a more particular and preferred aspect of the invention the muffler comprises:

(1) a housing adapted to receive said stream;

(2) at least one distributor within said housing for passing said stream into the interior of said housing and for dividing said stream into a multiplicity of separate streams;

(3) at least one shell within said housing for isolating as a void volume a minor portion of the volume circumscribed by said housing, said shell having perforations or openings in at least a portion thereof for receiving said separated streams, and said void volume being vented to the atmosphere; and (4) a fill-pack of macro-sized particles substantially (a) filling the remainder of the volume circumscribed by said housing, (b) surrounding said distributor, and cc) contacting said shell.

In a yet more particular and preferred aspect of the invention, a blow-off muffler for venting geothermal steam to the atmosphere is provided, comprising:

(1) a rectangular or square concrete housing adapted at a basal portion thereof with an ingress means to receive said steam and with an egress means to drain liquid from said housing;

(2) an inlet distributor pipe affixed to said housing for passing said steam into the interior of a basal portion of said housing, said pipe being closed at the interior end thereof and containing perforations or openings for dividing said steam into a multiplicity of separate streams;

(3) a shell within said housing for isolating as a void volume a minor portion of the enclosed volume of said housing, said shell being perforated in at least a portion thereof for receiving said separated streams, said void volume being vented to the atmosphere; and (4) a fill-pack of macro-sized particles composed of a material selected from the group consisting of rock, slag, steel and cast iron, said particles having average diameters in the range of from about one-quarter to twelve inches and substantially (a) filling the remainder of the volume of said housing, (b) surrounding said pipe and (c) contacting said shell.

BRIEF DESCRIPTION OF THE DRAWINGS

FIG. 1 is a muffler employing a single inlet and void volume (gas collector), the latter being vented to the atmosphere via a chimney-like extension of the shell.

FIG. 2 is a muffler employing multiple inlets and void volumes, the latter being established by shells which are perforated pipes extending from the top down into the body of the rock fill-pack.

FIG. 3 is a muffler in which the void volume (gas collector) is concentric and laterally external to the rock fill-pack. Alternatively, the inlet pipe may be introduced into the fill-pack from the top or bottom of the fill.

FIG. 4 is a rectangular muffler which, like that of FIG. 3 has a collector which is laterally external to the fill. In addition, the perforated inlet pipe is positioned within a larger pipe which is also perforated. This muffler is partially capped to provide more noise reduction.

EMBODIMENT OF THE INVENTION

Figure 1:
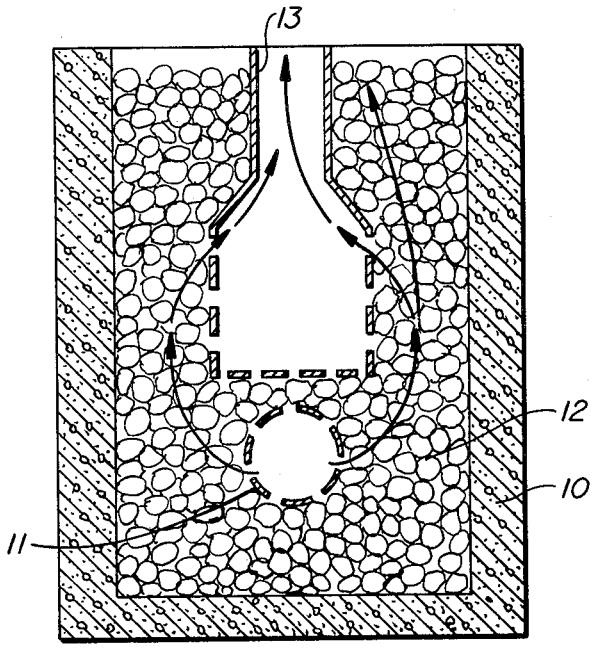
FIGS. 1–4 are cross-section drawings of representative blow-off mufflers of the present invention.

In a preferred embodiment of the invention, the blow-off muffler herein is as depicted in FIG. 1. The exterior housing 10 is rectangular and constructed of reinforced concrete which is about twelve inches thick. Housing 10 has internal dimensions of about fifteen by twenty feet and a height of about ten feet. A muffler of these dimensions conveniently and effectively attenuates, for example with a noise reduction of at least 40 decibels relative to an unmuffled vent, a stream of geothermal steam exhibiting a flow of one million lbs/hr at a pressure of 200 psig.

Via a feed line, not shown, which is attached to housing 10 by conventional means, for example bolted flanges, also not shown, high pressure steam is introduced into the muffler via inlet pipe line 11. Inlet 11 is a multiperforated steel pipe which is closed on its inboard end. The perforations are of a size, for example about one-half inch in diameter, which is large enough to provide for a satisfactory flow rate of steam yet small enough to exclude surrounding fill-pack 12 from the interior of inlet 11.

Fill-back 12 is sized quarry rock having average diameters in the range of from about one to eight inches. This pack surrounds inlet 11 and collector 13. It provides a further means for diversion of the flow paths of the separated streams generated by the perforations in inlet 11. The fill-pack provides a flow path for separated streams to the atmosphere via the interstices of the pack to collector 13 and via fill-pack 12.

Collector 13 is a bottle shaped steel shell which is affixed to housing 10 by mounting beams or brackets, not shown. Substantial support and stabilization of collector 13 in situ in housing 10 is also provided by the fill-pack 12. Perforations in the sides and bottom of collector 13, which are similar to those in inlet 11, permit ingress of attenuated steam into collector and passage to the atmosphere through the void volume therein. Preferably a minor portion of the stream flowing through the muffler is outside the collector and through the fill-pack surrounding the collector. A larger fraction of the flow may be in this fashion and there yet be effective operation of the muffler relative to a conventional muffler. To this end, however, at least one-third of the flow must be via the collector, preferably at least two-thirds.

Conventional rock-filled mufflers emit the entire flow of steam solely through the entire body of the rock fill. In order to prevent ejection of the rock into the atmosphere, this flow must be limited to approximately 1800 lbs/hr./ft$^2$. Steam flow rates from commercial geothermal wells for power plant use are normally in the one to four million lbs/hr. range. Consequently, a huge muffler is required to satisfactorily handle such a flow. The collector of the present invention carries the bulk of the flow, permitting a drastic reduction in the size of the muffler required to handle this flow yet provides excellent noise reduction.

A yet further advantage of the muffler herein over a conventional rock-filled muffler is that the former drys faster after use. This translates directly into greatly reduced corrosion problems.

THE HOUSING

The housing, items 10, 20, 30 and 40 of FIGS. 1–4, is closed at the bottom. The top of the housing is usually open, but it may be partially closed, see for example cover 47 and vent line 48 of FIG. 4. It may be constructed of any suitable material of strength capable of maintaining the housing configuration, for example concrete, steel plate, masonry, wood, earth (as in a berm or pit), and the like. Generally concrete is preferred for reasons of strength and resistance to corrosive effects of geothermal steam or of other high pressure somewhat corrosive fluids desirably attenuated.

The shape of the housing may vary widely, including circular, rectangular, square, hexagonal, and the like, as well as irregular shapes and combinations of the foregoing. For reasons of simplicity of construction, a rectangular or square configuration is preferred.

The size of the housing desirably used varies depending upon the pressure-volume flow relationships of the stream which is vented. It is noteworthy that the height of the housing needs to be sufficient to accomodate a fill-pack which will not appreciably surge under the influence of the flow stream. In general, satisfactory heights are in the range of from about two to twenty feet, preferably three to twelve feet.

Figure 4:
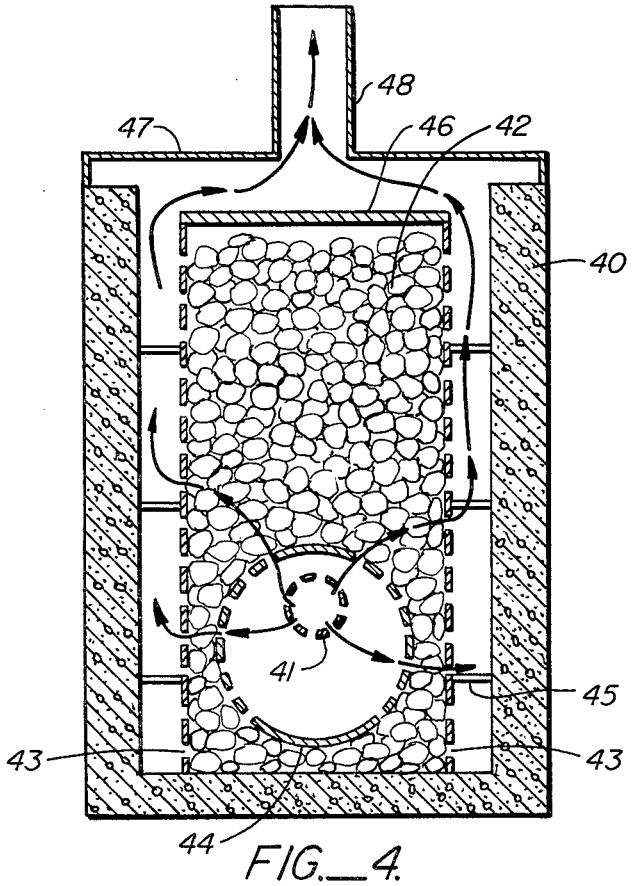

The cover, 46 of FIG. 4, does not constrain the upper surface of the fill-pack, as by covering with a perforated plate. Instead, the fill-pack is held in place by gravity. Otherwise, failure of a restraining cover could result in violent and dangerous ejection of hot rock fill.

The average inside diameter or width of the housing desirably used varies depending upon whether one or more void volumes are desirably used. In general, satisfactory inside widths are in the range of from about two to fifty feet. Where a single void volume is to be employed, for example as in FIG. 1, the inside width of the housing should be in the range two to ten feet, preferably three to eight feet.

The stream passed into the muffler may contain entrained water and/or some condensation may be experienced. Accordingly, provision for liquid removal from the muffler may be desirable, for example gravity flow via a drain line from the bottom of the housing or a bottom sump and pump combination, and the like.

THE DISTRIBUTOR

The muffler herein must contain at least one distributor and may desirably contain two (see FIG. 2) or more, for example up to about ten.

In blow-off operation, the distributor, items 11, 21, 31, and 41 of FIGS. 1–4, respectively, receives the fluid stream and separates that stream into a multiplicity of individual streams directed to impinge upon the fill-pack of the muffler. Stream separation is engendered by a plurality of holes or perforations in the peripheral surface of the distributor which communicate with the fill-pack zone (substantially the volume encompassed by the housing less that of the void volume) of the muffler. These holes or perforations must be large enough to permit effective fluid flow yet small enough to exclude entry of the fill-pack into the distributor, that is, in the range of from about one-fourth to three inches in diameter or width. The inner or downstream end of the distributor is closed or capped although it too may also contain holes or perforations. The diameter or width of the distributor or inlet is desirably in the range of from about one to twenty four inches depending upon the flow rate.

For the mode as in FIG. 4 and a rate of one million lbs/hr. of steam, the inner distributor is twelve to eighteen inches in diameter and the outer distributor is twenty-four to forty-eight inches in diameter and is desirably composed of steel plate three-sixteenth to one inch thick.

The shape of the distributor may vary widely, although generally a simple straight pipe section is usually effective and economical. Alternative shapes suitable for use herein include that of a torus, a circular section of pipe, a sphere, a hemisphere, and the like.

The compound distributor, items 41 and 44 of FIG. 4 consists of two shells and provides more even steam distribution, lower noise, less erosion of the fill-pack from high velocity steam jetting and permits improved inspection and maintenance access.

The distributor may be constructed of materials comprising steel pipe or plate, aluminum, and the like.

THE SHELL

The muffler herein must contain at least one shell and may desirably contain two, three (see FIG. 2) or more, for example up to about two hundred, depending upon the size and flow capacity of the shell.

The shell, items 13, 23, 33 and 43 of FIGS. 1–4, respectively, herein is rigid and isolates as a void volume (gas collector) a minor portion (3 to 49% of the volume enclosed by the housing) of the housing volume. This void volume communicates with the atmosphere, provides for collection of fluid and for venting thereof to the atmosphere. While the void volume markedly reduces the fill-pack content of the muffler, the fill-pack functioning as the principal sound attenuating means, surprisingly, the void volume of the muffler of the invention permits effective operation with a unit which is one-third to one-half the size of a unit without a void volume element. Thus for a given fluid flow and in terms of unit cost, the advantage of the present muffler over a conventional rock-filled muffler is outstanding.

Figure 2:
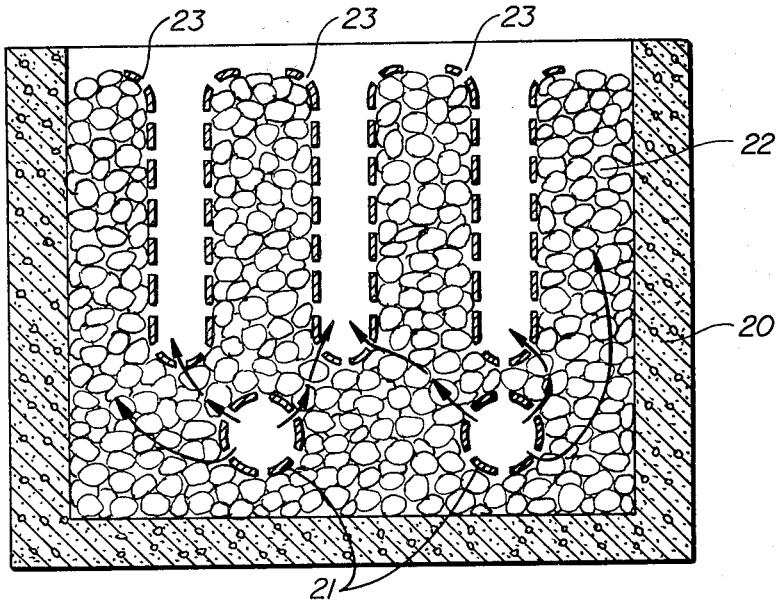

The shell may be supported by members affixed to the housing, such as spacers 45 of FIG. 4, by the fill-pack alone, that is free floating in the pack, or by a combination of such means. Support by the surrounding fill-pack is illustrated in FIGS. 1 and 2. Another example is wherein many perforated pipes are inserted into the fill-pack.

The shell may comprise various materials, as steel plate or pipe, masonry, concrete, aluminum and the like. Generally plate of significant thickness is desirable in most heavy duty applications. For light duty, the shell may comprise wire mesh screen, especially where clean steam is being vented.

Perforations or a plurality of holes in the peripheral surface of the shell provide communication with the fill-pack zone. Like those of the distributor, these perforations or holes are sized to exclude passage of the fill-pack through them. The entire shell, or merely a basal portion thereof as required to effect a desired fluid flow geometry, may contain these perforations.

Figure 3:
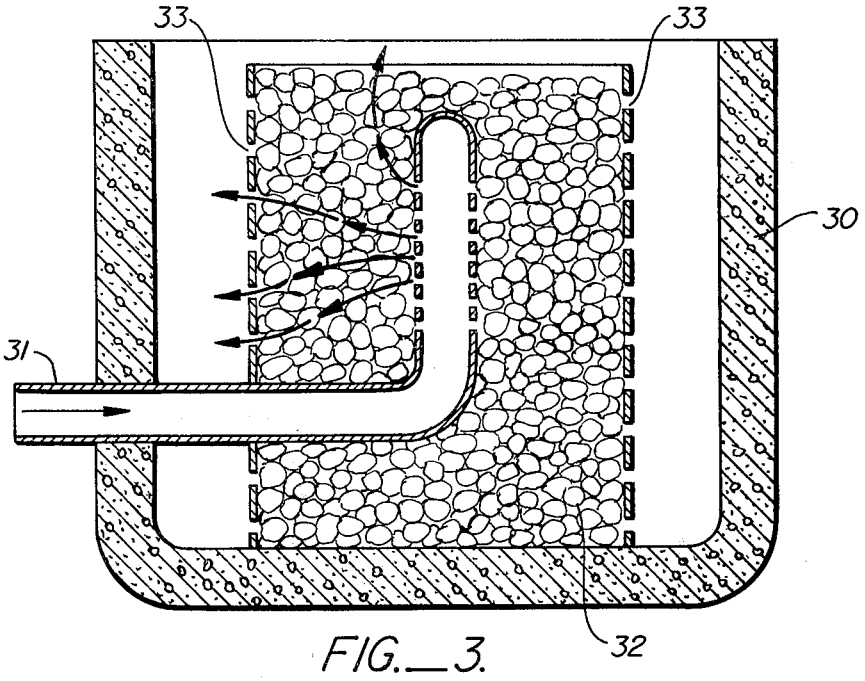

The shape of the shell may vary widely, ranging from a pipe section with open exterior end and open or capped interior end, to a bottle shaped unit as in FIG. 1, to a fill-pack retainer having one or both ends closed (see 46 of FIG. 4) as in FIGS. 3 and 4, and the like capable of defining and maintaining a void volume in communication with the fill-pack and with the atmosphere.

THE FILL-PACK

The fill-pack of the invention comprises macro-sized (average diameters in the range of from about one-quarter to eighteen inches) which provide the main acoustic energy-absorbing means of the muffler herein. The composition of the particles may comprise various materials such as rock, especially porous rock, steel, cast iron, slag, and the like. The configuration of these particles is desirably substantially spherical or irregular, that is, in contrast to generally flat, and which do not pack solidly but yield a pack containing interstices.

It is apparent that many different embodiments of this invention may be made without departing from the scope and spirit thereof; and therefore, it is not intended to be limited except as indicated in the appended claims.

What is claimed is:

1. In a particle-fill, blow-off muffler for use in passing a stream of pressurized fluid into the atmosphere, the improvement comprising:

a housing having sufficient height to accommodate, under the influence of said stream, a non-surging particle-fill; and a void volume having a volume in the range of from about 3 to 49 percent of the volume surrounded by said housing and being defined by a shell containing holes or openings communicating with said fill, said void volume being adapted to pass to the atmosphere at least one-third of said stream after passage through but a portion of said fill.

2. A muffler as in claim 1 wherein said stream is introduced via a distributor into a basal compartment of said muffler, said compartment being separated from said fill by a perforated element selected from the group consisting of concrete floor, wire mesh screen, metal plate and metal grid.

3. A muffler as in claim 1 wherein said stream is introduced via a distributor into a lower lateral compartment of said muffler, said compartment being separated from said fill by a perforated element selected from the group consisting of concrete wall, wire mesh screen, metal plate and metal grid.

4. A blow-off muffler for use in passing a stream of pressurized geothermal steam into the atmosphere, comprising:

a housing adapted to receive said stream, said housing having a height in the range of from about 2 to 20 feet and sufficient to accommodate a fill-pack which does not surge under the influence of said stream;

an amount of distributor(s) in the range of from 1 to about 10 within said housing for passing said stream into the interior of said housing and for dividing said stream into a multiplicity of separate streams, said distributors having a diameter or width in the range of from about 1 to 24 inches and containing a plurality of holes or perforations having a diameter or width in the range of from about ¼ to 3 inches and sized to exclude passage of said fill-pack; an amount of shell(s) in the range of from 1 to about 200 within said housing for isolating as a void volume a portion in the range of from about 3 to 49 percent of the volume circumscribed by said housing, said shells having perforations or openings sized to exclude passage of said fill-pack, and said void volume being adapted to pass to the atmosphere at least one-third of said stream after passage through but a portion of said fill-pack; and a fill-pack of macro-sized non-packing particles having average diameters in the range of from about ¼ to 18 inches substantially (1) filling the remainder of said circumscribed volume, (2) surrounding said distributors and (3) contacting said shells.

5. A muffler as in claim 4 wherein said housing is rectangular or square and is concrete, said distributor is a pipe, and said fill-pack is rocks.

6. A muffler as in claim 4 wherein said housing is adapted at a basal portion with an egress means for withdrawing liquid.

7. A muffler as in claim 4 wherein said housing is rectangular, has internal dimensions of about fifteen by twenty feet and a height of about 10 feet.

8. A muffler as in claim 4 wherein said shell is composed of steel plate or pipe.

9. A muffler as in claim 4 wherein said shell is free floating.

10. A muffler as in claim 4 wherein said shell is affixed to said housing.

* * * * *